US005947710A

United States Patent [19]

Cooper et al.

[11] Patent Number: 5,947,710

[45] **Date of Patent: *Sep. 7, 1999**

[54] ROTARY COMPRESSOR WITH REDUCED LUBRICATION SENSITIVITY

[75] Inventors: Clark V. Cooper, Glastonbury, Conn.; Paul J. Bushnell, Syracuse, N.Y.; Martin M. Mertell, Denver, N.C.

[73] Assignee: Carrier Corporation, Syracuse, N.Y.

[ * ] Notice: This patent is subject to a terminal disclaimer.

[21] Appl. No.: 08/877,018

[22] Filed: Jun. 16, 1997

Related U.S. Application Data

[63] Continuation-in-part of application No. 08/568,788, Dec. 7, 1995, Pat. No. 5,672,054.

[51] Int. Cl.[6] ..... F04C 18/356

[52] U.S. Cl. ..... 418/63; 418/178; 428/408; 428/634

[58] Field of Search ..... 418/63, 178; 428/408, 428/457, 634

[56] References Cited

U.S. PATENT DOCUMENTS

| | | | |
|---|---|---|---|
| Re. 34,035 | 8/1992 | Dimigen et al. | 428/244 |
| 4,961,831 | 10/1990 | Bergmann et al. | 204/192.16 |
| 5,075,181 | 12/1991 | Quinto et al. | 428/698 |
| 5,108,813 | 4/1992 | Noda et al. | 428/408 |
| 5,263,834 | 11/1993 | Sato et al. | 418/178 |
| 5,273,410 | 12/1993 | Kitaichi et al. | 418/178 |
| 5,288,556 | 2/1994 | Lemelson | 428/408 |
| 5,310,596 | 5/1994 | Bigelow et al. | 428/408 |
| 5,368,939 | 11/1994 | Kawamura et al. | 428/408 |
| 5,376,444 | 12/1994 | Grotepass et al. | 428/336 |
| 5,391,422 | 2/1995 | Omori et al. | 428/212 |
| 5,423,970 | 6/1995 | Kügler et al. | 204/298.03 |
| 5,431,963 | 7/1995 | Rzad et al. | 427/534 |
| 5,433,977 | 7/1995 | Sarin et al. | 427/450 |
| 5,445,887 | 8/1995 | Casti | 428/408 |
| 5,455,081 | 10/1995 | Okada et al. | 427/528 |
| 5,458,754 | 10/1995 | Sathrum et al. | 204/192.38 |
| 5,458,927 | 10/1995 | Malaczynski et al. | 427/527 |
| 5,466,431 | 11/1995 | Dorfman et al. | 423/446 |
| 5,478,650 | 12/1995 | Davanloo et al. | 428/408 |
| 5,482,602 | 1/1996 | Cooper et al. | 204/192.11 |
| 5,672,054 | 9/1997 | Cooper et al. | 418/63 |

FOREIGN PATENT DOCUMENTS

| | | | |
|---|---|---|---|
| 63-277883 | 11/1988 | Japan | 418/63 |
| 64-15793 | 1/1989 | Japan . | |
| 07133194 | 5/1995 | Japan . | |

OTHER PUBLICATIONS

"*Industrial Heating*"; Title: Application and Utility of Industrial Diamond–Like Films—pp. 12–14, Jul. 1988.

"*Surface and Coatings Technology*", 47 (1991), pp. 315–326; Title: Physical Properties of Carbon Films Produced Using a Hybrid Physical Vapour Deposition Technique.

"*Surface and Coatings Technology*", 47 (1991), pp. 662–667, Title: Diamond–Like Carbon Applied To Bioengineering Materials.

"*Wear Protection for Gears*", The Journal of Gear Manufacturing, Gear Technology, Heat Treating; Frederick J. Teeter & Manfred Berger, Mar./Apr. 1996, pp. 27–29.

"*Diamond and Related Materials*", International Journal on the Science and Technology of Diamond and Related Materials, Title: Engineering Applications for Diamond–Like Carbon, A. Matthews and S.S Eskildsen, vol. 3, Nos. 4–6, Apr. 1994, ISSN 0925–9635, pp. 902–911.

"*Diamond and Related Materials*", International Journal on the Science and Technology of Diamond and ReElated Materials; Title: Tribology of Carbon Coatings: DLC, Diamond and Beyond; S.J. Bull, vol. 4, Nos. 5–6, May 1995, ISSN 0925–9635, pp. 827–836.

*Primary Examiner*—John J. Vrablik

[57] ABSTRACT

Lubrication deficiencies related to the use of lubricants in HFC refrigeration compressors can be mitigated by providing a diamond-like-carbon coating on a member subject to wear due to lubrication deficiencies. Specifically, the tip of the vane of a rotary compressor is coated with a diamond-like-carbon coating made up of alternating layers of tungsten carbide and a lubricious material 0.5 to 5.0 microns thick.

17 Claims, 3 Drawing Sheets

ROTARY COMPRESSOR WITH REDUCED LUBRICATION SENSITIVITY

This application is a continuation-in-part of commonly assigned application Ser. No. 568,788 filed Dec. 7, 1995, U.S. Pat. No. 5,672,054.

BACKGROUND OF THE INVENTION

In a fixed vane or rolling piston compressor, the vane is biased into contact with the roller or piston. The roller or piston is carried by an eccentric on the crankshaft and tracks along the cylinder in a line contact such that the piston and cylinder coact to define a crescent shaped space. The space rotates about the axis of the crankshaft and is divided into a suction chamber and a compression chamber by the vane coacting with the piston. In a vertical, high side compressor an oil pickup tube extends into the oil sump and is rotated with the crankshaft thereby causing oil to be distributed to the locations requiring lubricant. In the case of non CFC or HCFC operation, such as HFC for example, there may be inadequate lubrication. One reason for this is that the chlorine in refrigerants such as Freon® reacts with compatible lubricants to produce a protective film or coating. Also, HFC refrigerants have different operating characteristics which can impact the lubrication function. R-410A, for example, has a higher operating pressure than any common refrigerant. An area of sensitivity to inadequate lubrication is the line contact between the vane and piston and can cause excessive wear.

The synthetic oils, such as an ester oil of one or more monocarboxylic acids like polyol ester oils (POE), used with the new refrigerants release dissolved refrigerants much more rapidly than mineral oil and, as a result, the maintenance of adequate oil pressure under transient conditions is more difficult. A characteristic of the POE oils is that because they are more polar they do not "wet" the surfaces of the more polar metals such as aluminum or tin as well as mineral oil. As a result, more polar metals must be supplied continuously with a flow of oil from the pump i.e. with POE oils the pump must replenish the oil film with minimal interruption. Synthetic HFC-miscible lubricants such as those of the polycarbonate and polyvinyl ether (PVE) types can be used. Mineral oils (MO) and alkylbenzene (AB) lubricants offer better lubricity for rubbing surfaces subjected to high PV operation, but they have poor miscibility in HFC refrigerants. These oils form adsorbed films on the rubbing surfaces that improve their ability to protect the surface under boundary lubrication conditions, i.e. in the absence of full film hydrodynamic lubrication. In some applications where the immiscibility of MO and AB in the HFC refrigerant has no adverse effect on oil return to the compressor and oil management in the system and in the compressor, these lubricants could be used in HFC system, such as Room Air-Conditioners (RACs).

Accordingly, it is very desirable to qualify a suitable oil for HFC applications. The relatively low PV index, corresponding to the oil's rheological effects, is speculated as the major contributor to the deficiencies of POE oils. Thus, as the oil film breaks down, a catastrophic degradation in lubricating ability occurs and presents problems inherent with the use of present POE oils in refrigeration compressor environments. Inherent with most HFC lubricant applications is the need for the addition of antiwear additives to compensate for the poor lubricating qualities of this type lubricant. These additives can be harmful to air conditioning systems unless properly qualified. This is not generally known in the air conditioning industry.

SUMMARY OF THE INVENTION

One characteristic of deficient or failed lubrication is wear between contacting parts. The present invention minimizes the effects of insufficient or failed lubrication as well as increasing the durability of the vane/roller interface with very high-pressure HFC refrigerants like R-410A, even when better lubricity lubricants like mineral and alkybenzene oils are opted for. Rotary compressors employing other HFC-miscible lubricants, such as those of the polycarbonate and Polyvinyl Ether (PVE) varieties also benefit from the presence of the proposed coating on the vane tips, particularly with very high-pressure HFC refrigerants like R-410A. This can be achieved by reducing the coefficient of friction between the members of interest and by increasing the resistance of one or more members to wear. In fixed vane or rolling piston compressors, a diamond-like-carbon (DLC) coating, has been found to reduce the coefficient of friction between the vane and rotor dramatically reducing localized temperatures and thereby providing a much less severe condition tending to compromise the wear characteristics. Although the present invention permits delaying the catastrophic effects of compromised lubrication, wear and failure will eventually occur, as is true of conventional devices with conventional lubricants. Basically, the present invention gives a useful life corresponding to the use of conventional lubricants with HCFC refrigerants such as R-22 rather than the shorter life often associated with synthetic lubricants such as POE with refrigerants such as R-410A. Specifically, the low PV index still allows for modest asperity contact and thus wear does take place, but at a significantly lower rate. Additionally, the use of a DLC coating eliminates or significantly reduces in many cases the need for/or concentration of anti-wear additives and the attendant system problems. Therefore, the DLC concept in conjunction with HFC lubricants improves overall system reliability.

Although a DLC coating reduces wear under compromised lubrication conditions, its presence can change the dimensions of a highly accurately machined part within the range of machining tolerances. The vane of a rolling piston compressor, for example, is located in a slot between the suction chamber and compression chamber thereby providing a potential leakage path. The vane is in sealed, moving contact with a motor end bearing and a pump end bearing in an single cylinder device and with a bearing and separator plate in a two cylinder device. The vane tip is in sealing contact with the moving piston.

It is an object of this invention to minimize or eliminate part wear due to boundary lubrication or the break down thereof.

It is another object of this invention to improve sound quality and performance by lowering the coefficient of friction between moving parts. These objects, and others as will become apparent hereinafter, are accomplished by the present invention.

Basically, a part of a HFC refrigeration compressor which is subject to localized wear and is normally lubricated by MO a synthetic lubricant such as, AB, PVE and polycarbonate oils is coated with a DLC coating such that wear and sensitivity to deficient lubrication is reduced.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
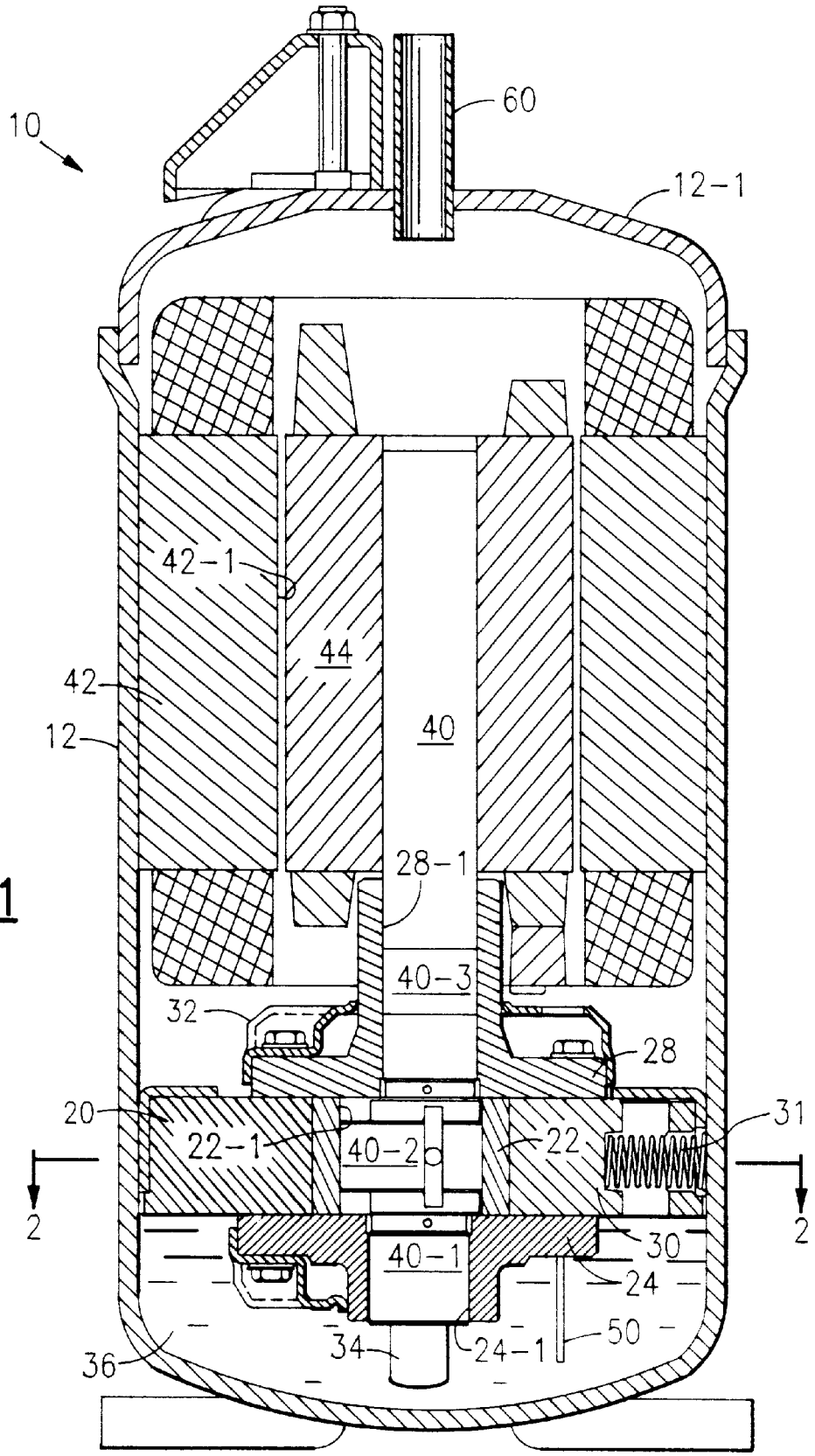
FIG. 1 is a partially sectioned view of a compressor employing the present invention.
Figure 2:
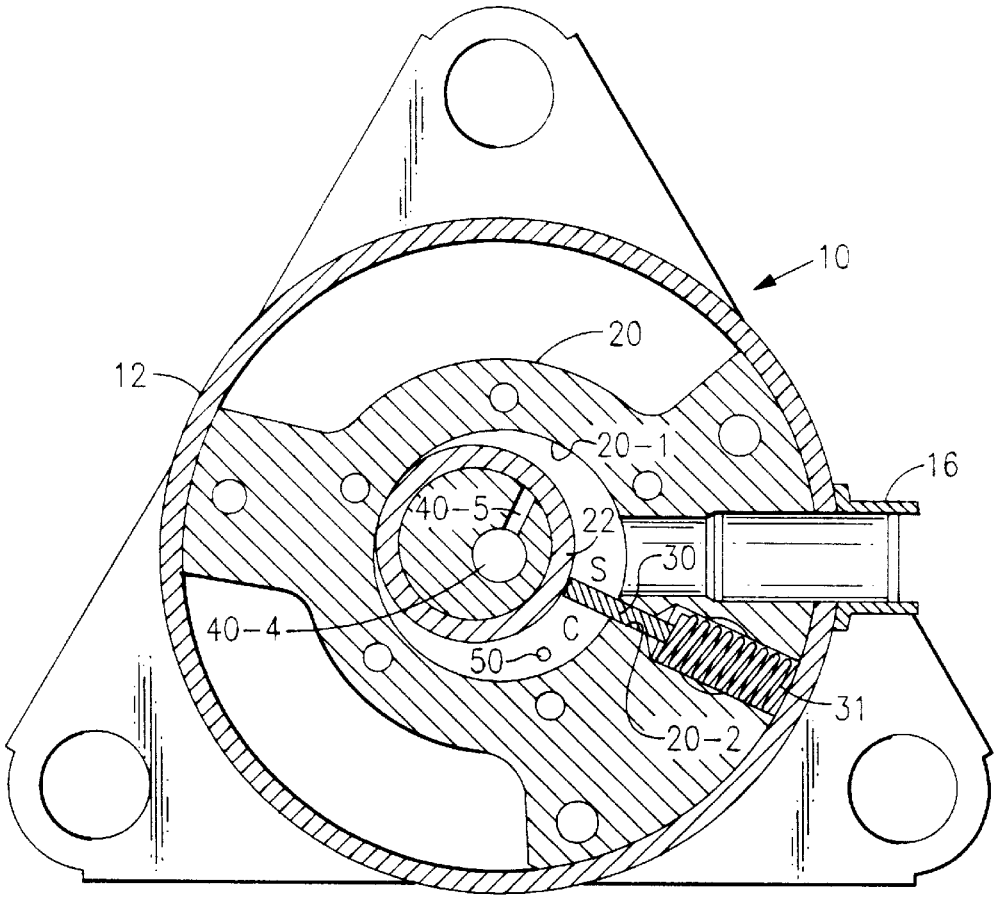
FIG. 2 is a sectional view taken along line 2—2 of FIG. 1.

In FIGS. 1 and 2, the numeral 10 generally designates a vertical, high side, rolling piston compressor. The numeral 12 generally designates the shell or casing. Suction tube 16 is sealed to shell 12 and provides fluid communication between a suction accumulator (not illustrated) in a refrigeration system and suction chamber S. Suction chamber S is defined by bore 20-1 in cylinder 20, piston 22, pump end bearing 24, motor end bearing 28, and vane 30.

Eccentric shaft 40 includes a portion 40-1 supportingly received in bore 24-1 of pump end bearing 24, eccentric 40-2 which is received in bore 22-1 of piston 22, and portion 40-3 supportingly received in bore 28-1 of motor end bearing 28. Oil pick up tube 34 extends into sump 36 from a bore in portion 40-1. Stator 42 is secured to shell 12 by shrink fit, welding or any other suitable means. Rotor 44 is suitably secured to shaft 40, as by a shrink fit, and is located within bore 42-1 of stator 42 and coacts therewith to define a motor. Vane 30 is located in vane slot 20-2 and is biased into contact with piston 22 by spring 31. As described so far, compressor 10 is generally conventional.

Figure 3:
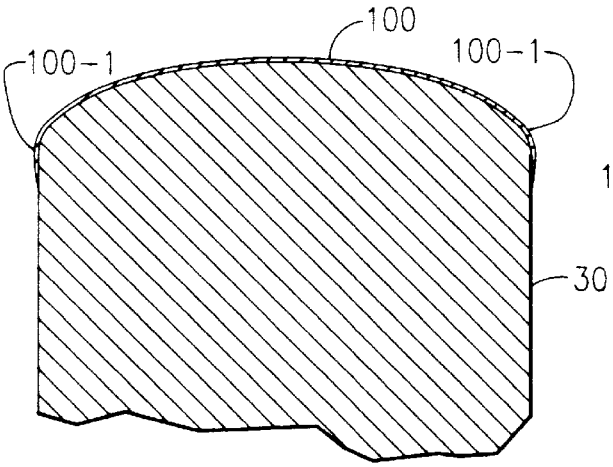
FIG. 3 is an enlarged horizontal sectional view of the vane of FIG. 1.
Figure 4:
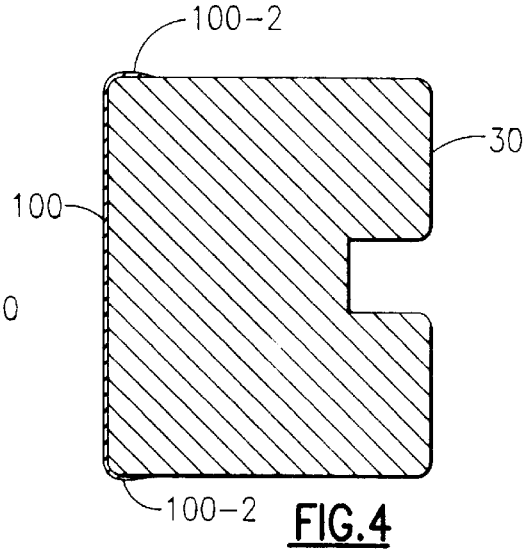
FIG. 4 is an enlarged vertical sectional view of the vane of FIG. 1.
Figure 5:
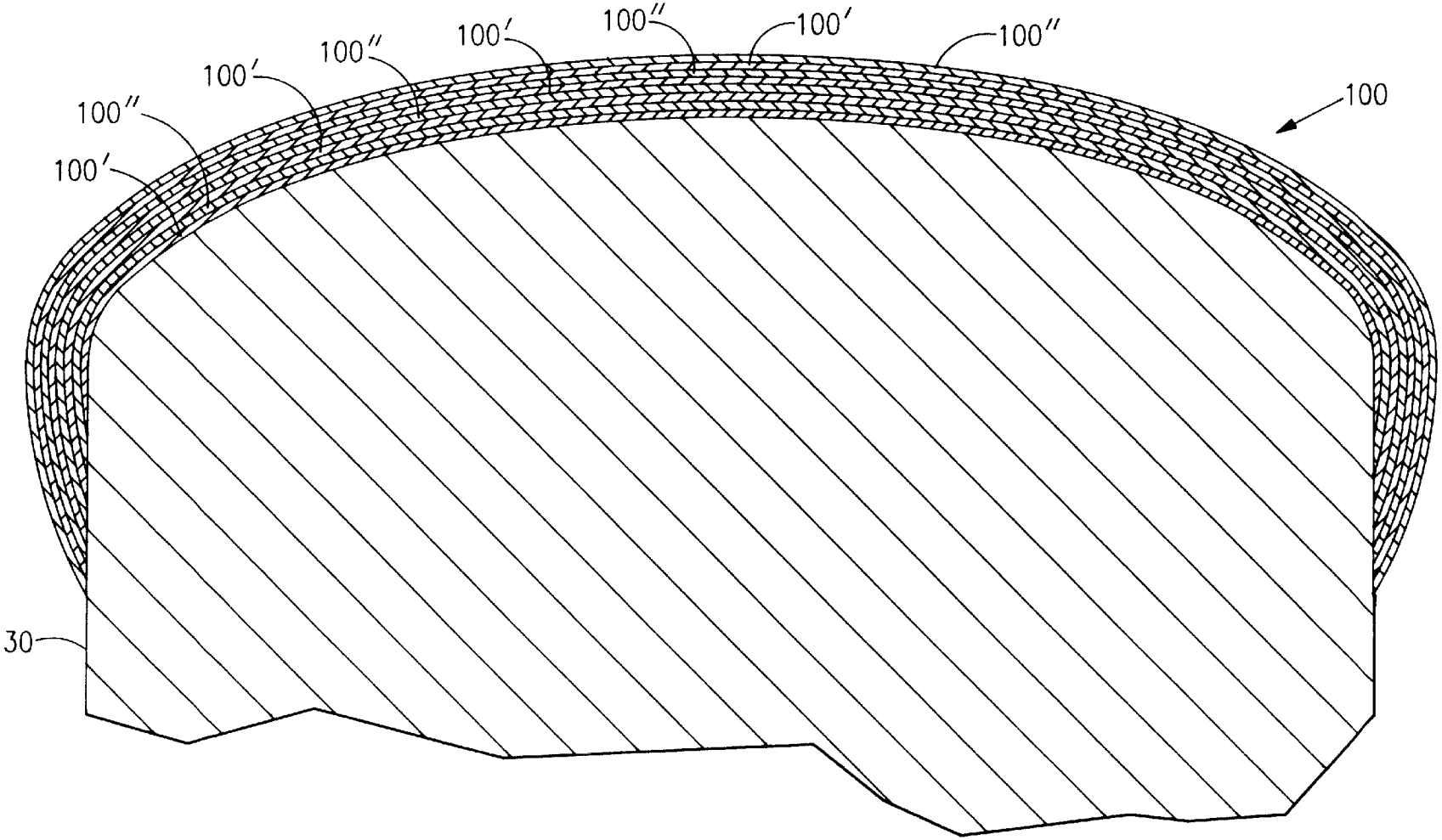
FIG. 5 is an enlarged view of a portion of FIG. 3.

The present invention adds a DLC coating 100 to vane 30, specifically to the tip or nose of vane 30 which contacts piston 22. The DLC coating 100 is formed by a physical vapor deposition process called DC magnetron sputtering in which a carbonaceous gas, such as acetylene, is ionized in a glow discharge. The process forms a series of nanolayers 100' of carbon and tungsten carbide, a series of alternating hard 100' and lubricious layers 100", with a total nanolaminate coating thickness which is grown to a range of 0.5 to 5.0 $\mu$m, with a nominal 2.0 $\mu$m thickness being preferred. This coating is very hard while providing lubricity and when applied to frictional surfaces such as the vane tip or nose, provides incremental improvements to the wear characteristics of the mating parts. The preferred embodiment of the DLC coating 100 is one in which the microstructure contains multiple bilayers of the lubricious phase 100", the major component of which is amorphous carbon, and the hard, wear-resistant phase 100', which is an amorphous assemblage of carbon and a transition metal. Any of several transition metals may be used, including tungsten (W), vanadium (V), zirconium (Zr), niobium (Nb), and molybdenum (Mo), the preferred embodiment being a composition of tungsten (W). The thickness of the elements within the compositionally modulated bilayer is important in order to reduce the magnitude of the intrinsic or growth stress within the coating, such that the proclivity of the coating system to fracture is reduced. The range of bilayer thickness is 1 to 20 nm, with the preferred embodiment being between 5 and 10 nm. FIGS. 3 and 4 are sectional views of vane 30 showing a greatly exaggerated DLC coating 100 on the tip of vane 30 while FIG. 5 illustrates the bilayers 100' and 100" making up DLC coating 100. It will be noted that coating 100 has overlaps 100-1 extending a limited distance onto the side portions of the vane adjacent the tip. As to the vane slot 20-2, the overlaps 100-1 would only tend to coact therewith at the portion of the stroke of vane 30 when it is totally withdrawn into vane slot 20-2. This limited potential interference can be treated by increasing the chamfer on the suction side of the vane slot 20-2 since fluid pressure in the compression chamber C biases the vane 30 towards the suction chamber S. The overlaps 100-2 on the top and bottom of vane 30 which contact motor end bearing 28 and pump end bearing 24, respectively, are the most problematical but can be addressed by minimizing the overlap at these areas. Alternatively, the entire vane 30 can be coated but this presents two problems in that it changes the dimensions of highly accurately machined parts and in that there is a significant increase in cost.

In operation, rotor 44 and eccentric shaft 40 rotate as a unit and eccentric 40-2 causes movement of piston 22. Oil from sump 36 is drawn through oil pick up tube 34 into bore 40-4 which may be skewed relative to the axis of rotation of shaft 40 and acts as a centrifugal pump. The pumping action will be dependent upon the rotational speed of shaft 40. As best shown in FIG. 2, oil delivered to bore 40-4 is able to flow into a series of radially extending passages, in portion 40-1, eccentric 40-2 and portion 40-3 exemplified by bore 40-5 in eccentric 40-2, to lubricate bearing 24, piston 22, and bearing 28, respectively. The excess oil flows from bore 40-4 and either passes downwardly over the rotor 44 and stator 42 to the sump 36 or is carried by the gas flowing from annular gap between rotor 44 and stator 42 and impinges and collects on the inside of cover 12-1 before draining to sump 36. Piston 22 coacts with vane 30 in a conventional manner such that gas is drawn through suction tube 16 to suction chamber S. The gas in suction chamber S is compressed and discharged via a discharge valve (not illustrated) into the interior of muffler 32. The compressed gas passes through muffler 32 into the interior of shell 12 and pass via the annular gap between rotating rotor 44 and stator 42 and through discharge line 60 to the refrigeration system (not illustrated).

The foregoing description of the operation would only lubricate the vane 30 via lubricant entrained in the refrigerant, by the lubricant feed to the eccentric 40-2, etc. reaching the bore 20-1 in its return path and by leakage between vane 30 and vane slot 20-2. This deficiency was addressed in commonly assigned U.S. patent application Ser. No. 5,564,917, which discloses injecting oil into the compression chamber C via line 50 when uncovered by piston 22 due to the higher pressure acting on sump 36. This addresses the supplying of lubricant where needed but does not address the inherent deficiencies of MO and synthetic lubricants such POE AB, PVE and polycarbonate oils when used in combination with HFC refrigerant compressors which are addressed by the present invention.

Although the present invention has been illustrated and described in terms of a vertical rolling piston compressor, other modifications will occur to those skilled in the art. For example, the invention is applicable to horizontal compressors as well as other types of compressors having localized wear because of lubrication deficiencies. Similarly the motor can be a variable speed motor. It is therefore intended that the present invention is to be limited only by the scope of the appended claims.

What is claimed is:

1. An improved rotary compressor for compressing HFC refrigerant which is lubricated by a synthetic lubricant, said rotary compressor having pump means including a piston rollably disposed within a bore of a cylinder and a vane having a tip coacting with said piston, the improvement comprising:

said tip having a diamond-like-carbon coating thereon made up of a series of alternating hard and lubricious layers whereby the coefficient of friction between said tip and said piston is reduced and said tip has reduced wear even in the absence of sufficient lubricant as compared to a tip without said diamond-like-coating.

2. A high side rotary compressor for compressing HFC refrigerant which is lubricated by a lubricant selected from the group consisting of mineral oils, alkylbenzene, polyvinyl ether and polycarbonate lubricants comprising:

shell means having a first end and a second end;

cylinder means containing pump means including a vane and a piston coacting with said cylinder means to define suction and compression chambers;

said cylinder means being fixedly located in said shell means near said first end and defining with said first end a first chamber which has an oil sump containing said oil lubricant;

first bearing means secured to said cylinder means and extending towards said oil sump;

second bearing means secured to said cylinder means and extending towards said second end;

motor means including rotor means and stator means;

said stator means fixedly located in said shell means between said cylinder means and said second end and axially spaced from said cylinder means and said second bearing means;

eccentric shaft means supported by said first and second bearing means and including eccentric means operatively connected to said piston;

said rotor means secured to said shaft means so as to be integral therewith and located within said stator so as to define therewith an annular gap;

suction means for supplying gas to said pump means;

discharge means fluidly connected to said shell means;

said vane having a tip coacting with said piston;

said tip having a diamond-like-carbon coating thereon made up of a series of alternating hard and lubricious layers whereby the coefficient of friction between said tip and piston is reduced and said tip has reduced wear even in the absence of sufficient lubricant as compared to a tip without said diamond-like-coating.

3. The compressor of claim 2 wherein said oil sump contains said lubricant.

4. The compressor of claim 2 wherein said coating is 0.5 to 5.0 $\mu$m thick.

5. The compressor of claim 4 wherein said series is made up of a plurality of bilayers 1 to 20 nm thick.

6. The compressor of claim 2 wherein said series is made up of a plurality of bilayers 1 to 20 nm thick.

7. The compressor of claim 2 wherein said lubricious layers are amorphous carbon.

8. The compressor of claim 7 wherein said hard layers are an amorphous assemblage of carbon and a transition metal.

9. The compressor of claim 7 wherein said hard materials are an amorphous assemblage of carbon and a transition metal.

10. A high side rotary compressor for compressing HFC refrigerant which is lubricated by a synthetic lubricant comprising:

shell means having a first end and a second end;

cylinder means containing pump means including a vane and a piston coacting with said cylinder means to define suction and compression chambers;

said cylinder means being fixedly located in said shell means near said first end and defining with said first end a first chamber which has an oil sump containing said oil lubricant;

first bearing means secured to said cylinder means and extending towards said oil sump;

second bearing means secured to said cylinder means and extending towards said second end;

motor means including rotor means and stator means;

said stator means fixedly located in said shell means between said cylinder means and said second end and axially spaced from said cylinder means and said second bearing means;

eccentric shaft means supported by said first and second bearing means and including eccentric means operatively connected to said piston;

said rotor means secured to said shaft means so as to be integral therewith and located within said stator so as to define therewith an annular gap;

suction means for supplying gas to said pump means;

discharge means fluidly connected to said shell means;

said vane having a tip coacting with said piston;

said tip having a diamond-like-carbon coating thereon made up of a series of alternating hard and lubricious layers whereby the coefficient of friction between said tip and piston is reduced and said tip has reduced wear even in the absence of sufficient lubricant as compared to a tip without said diamond-like-coating.

11. The compressor of claim 10 wherein said oil sump contains said lubricant.

12. The compressor of claim 10 wherein said coating is 0.5 to 5.0 $\mu$m thick.

13. The compressor of claim 12 wherein said series is made up of a plurality of bilayers 1 to 20 nm thick.

14. The compressor of claim 10 wherein said series is made up of a plurality of bilayers 1 to 20 nm thick.

15. The compressor of claim 10 wherein said lubricious layers are amorphous carbon.

16. The compressor of claim 15 wherein said hard layers are an amorphous assemblage of carbon and a transition metal.

17. The compressor of claim 15 wherein said hard materials are an amorphous assemblage of carbon and a transition metal.

* * * * *